US011223160B2

(12) United States Patent
Kida et al.

(10) Patent No.: US 11,223,160 B2
(45) Date of Patent: Jan. 11, 2022

(54) CONNECTOR

(71) Applicant: Sumitomo Wiring Systems, Ltd., Yokkaichi (JP)

(72) Inventors: Shinjiro Kida, Yokkaichi (JP); Yuma Mamiya, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/911,674

(22) Filed: Jun. 25, 2020

(65) Prior Publication Data

US 2020/0412051 A1 Dec. 31, 2020

(30) Foreign Application Priority Data

Jun. 27, 2019 (JP) ..... JP2019-119743

(51) Int. Cl.
*H01R 13/627* (2006.01)
*H01R 13/641* (2006.01)
*H01R 13/639* (2006.01)

(52) U.S. Cl.
CPC ..... *H01R 13/6272* (2013.01); *H01R 13/6275* (2013.01); *H01R 13/639* (2013.01); *H01R 13/641* (2013.01)

(58) Field of Classification Search
CPC ..... H01R 13/641; H01R 13/6272; H01R 13/639; H01R 13/6275
USPC ..... 439/489, 352
See application file for complete search history.

(56) References Cited

U.S. PATENT DOCUMENTS 6,514,099 B2 * 2/2003 Endo ..... H01R 13/641 439/357
6,527,579 B2 * 3/2003 Sato ..... H01R 13/4364 439/352
6,712,635 B1 * 3/2004 Nimura ..... H01R 13/6272 439/352
6,824,417 B1 * 11/2004 Nimura ..... H01R 13/641 439/352
7,223,113 B2 * 5/2007 Nakamura ..... H01R 13/6392 439/353
9,022,797 B2 * 5/2015 Kon ..... H01R 13/641 439/352
10,153,586 B1 * 12/2018 Schroll ..... H01R 13/6272
2004/0087206 A1 * 5/2004 Grubbs ..... H01R 13/639 439/489
2005/0245122 A1 * 11/2005 Fisher ..... H01R 13/6272 439/352
2013/0237083 A1 9/2013 Kon et al.

FOREIGN PATENT DOCUMENTS

JP 2013-187116 9/2013

* cited by examiner

*Primary Examiner* — Gary F Paumen
(74) *Attorney, Agent, or Firm* — Gerald E. Hespos; Michael J. Porco; Matthew T. Hespos

(57) ABSTRACT

A connector is provided with a housing including a lock arm and a detector movable to a standby position and a detection position with respect to the housing. The detector includes a locking piece to be locked to the lock arm at the standby position before both housings are connected. At least one of the detector and the housing includes a locking strengthening portion for displacing the detector in a direction to increase a locking engagement of the locking piece and the lock arm in a part configured to slide in contact with the other when the detector moves from the standby position to the detection position.

5 Claims, 7 Drawing Sheets

CONNECTOR

BACKGROUND

Field of the Invention

This disclosure relates to a connector.

Related Art

Japanese Unexamined Patent Publication No. 2013-187116 discloses a connector with a housing and a detector. The housing includes a deflectable lock arm that locks a mating housing to hold the housing and the mating housing in a connected state. The detector is assembled with the housing movably between an initial position and a detection position. The detector includes a resilient arm with a protrusion on a tip part. The detector is kept at the initial position by the contact of the protrusion of the resilient arm with a lock projection of the lock arm. If the housings are connected properly, the lock projection of the lock arm locks a lock receiving portion of the mating housing, and the protrusion of the resilient arm is separated from the lock projection. In that state, a pushing force is applied to the detector and brings the detector to the detection position. A standby position is set between the initial position and the detection position but does not affect the above-described operation of moving the detector.

The locking of the protrusion and the lock projection is maintained if the housings are not connected properly, and therefore the detector cannot reach the detection position. Conversely, an ability to move the detector to the detection position confirms that the housings have been connected properly.

The detector has a backlash eliminating portion that is squeezed against a slide-contact surface of the housing while moving the detector to the detection position. The backlash eliminating portion restricts rattling of the detector in a height direction, which is the deflecting direction of the resilient arm, and a direction intersecting a moving direction of the detector.

There is a concern about a clearance formed in the height direction between the detector and the housing if the detector has no backlash eliminating portion. For example, a force to push the detector toward the detection position before the housings are connected could displace the detector in the height direction if the detector does not have a backlash eliminating portion. This displacement of the detector in the height direction will reduce a locking engagement between the protrusion and the lock projection in a clearance range to the housing and could inadvertently release the locking of the protrusion and the lock projection with a corresponding reduction of the connection detection reliability. On the other hand, although the backlash eliminating portion can restrict rattling of the detector, the backlash eliminating portion does not contribute to increased locking of the protrusion and the lock projection.

Accordingly, it is aimed to provide a connector capable of enhancing the reliability of connection detection.

SUMMARY

This disclosure is directed to a connector with a housing that is connectable to a mating housing. A deflectable lock arm is provided on the housing and locks the mating housing in a connected state. A detector is movable between a standby position and a detection position with respect to the housing. The detector is allowed to move from the standby position to the detection position after the housings are connected. The detector includes a locking piece to be locked to the lock arm at the standby position before the housings are connected. At least one of the detector and the housing includes a locking strengthening portion in a part configured to slide in contact with the other when the detector moves from the standby position to the detection position. The locking strengthening portion displaces the detector in a direction to increase a locking engagement of the locking piece and the lock arm.

A pushing force may be applied to push the detector toward the detection position before the housings are connected. However, the locking strengthening portion displaces the detector in the direction to increase the locking engagement of the locking piece and the lock arm. Thus, an inadvertent movement of the detector to the detection position is prevented and the reliability of connection detection is enhanced.

The locking strengthening portion may have an inclined surface inclined to face the other of the detector and the housing in the part configured to slide in contact with the other of the detector and the housing. According to this configuration, when a force applied to push the detector toward the detection position causes the detector to incline smoothly and to displace in the direction to increase the locking engagement of the locking piece and the lock arm.

The locking strengthening portion may be provided on the detector. According to this configuration, the housing need not be complicated. Additionally, the detector can be displaced by its own locking strengthening portion, and dimensional errors in the locking strengthening portion are less likely.

The locking strengthening portion may be a rib capable of filling up a clearance between the detector and the housing in a direction intersecting a moving direction of the detector. According to this configuration, a dedicated backlash eliminating structure for filling up the clearance between the detector and the housing need not be provided and a configuration can be simplified Accordingly, this disclosure provides a connector capable of enhancing the reliability of connection detection.

DETAILED DESCRIPTION

A specific example of the connector of the present disclosure is described below with reference to the drawings.

Note that the invention is not limited to these illustrations and is intended to be represented by claims and include all changes in the scope of claims and in the meaning and scope of equivalents.

A connector includes a housing 10 and a detector 60. The housing 10 is connectable to a mating housing 90. Note that, in the following description, surface sides facing each other when the connection of the both housings 10, 90 is started are referred to as front ends concerning a front-rear direction. A vertical direction is based on figures except FIG. 2.

<Housing 10>

Figure 1:
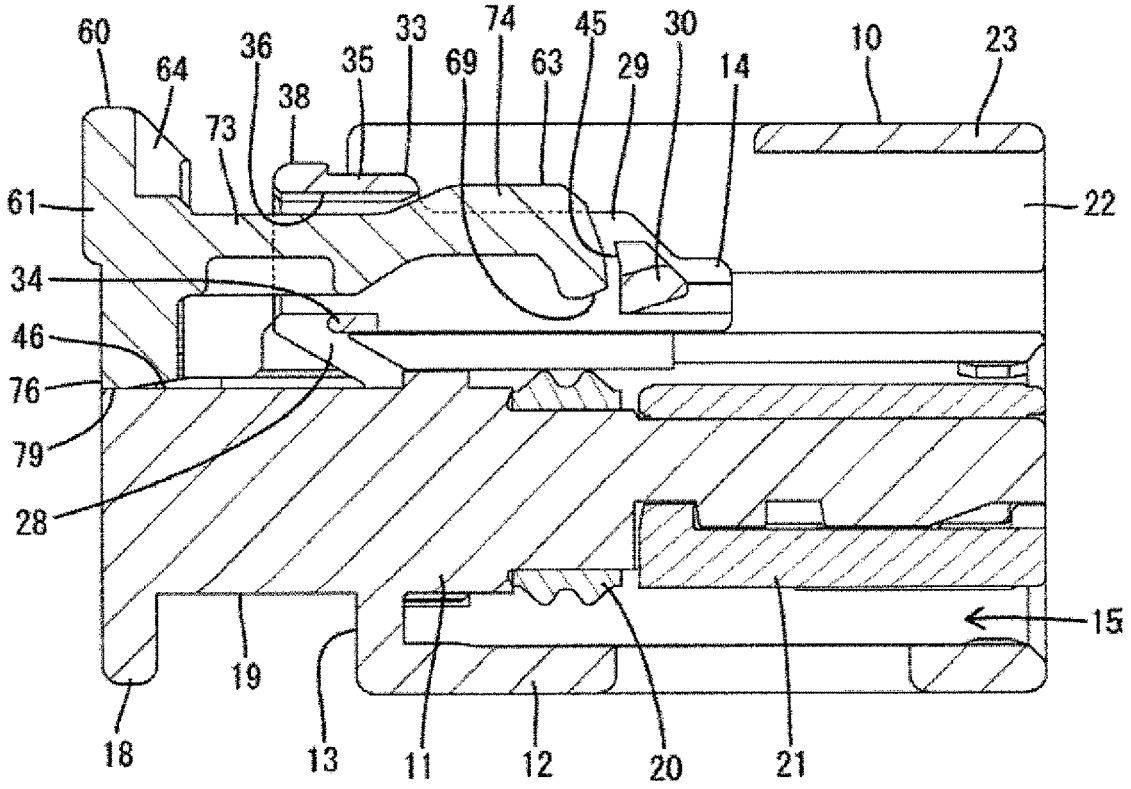
FIG. 1 is a side view in section showing a state where a detecting member is kept at a standby position with respect to a housing in a connector according to one embodiment.

The housing 10 is made of synthetic resin and includes, as shown in FIG. 1, a housing body 11, a fitting tube 12 surrounding the outer periphery of the housing body 11, a coupling 13 radially extending and linking the housing body 11 and the fitting tube 12, and a lock arm 14 provided above the housing body 11. A space between the housing body 11 and the fitting tube 12 and forward of the coupling 13 serves as a fitting space 15 into which a later-described receptacle 91 (see FIG. 3) of the mating housing 90 is fit.

Figure 5:
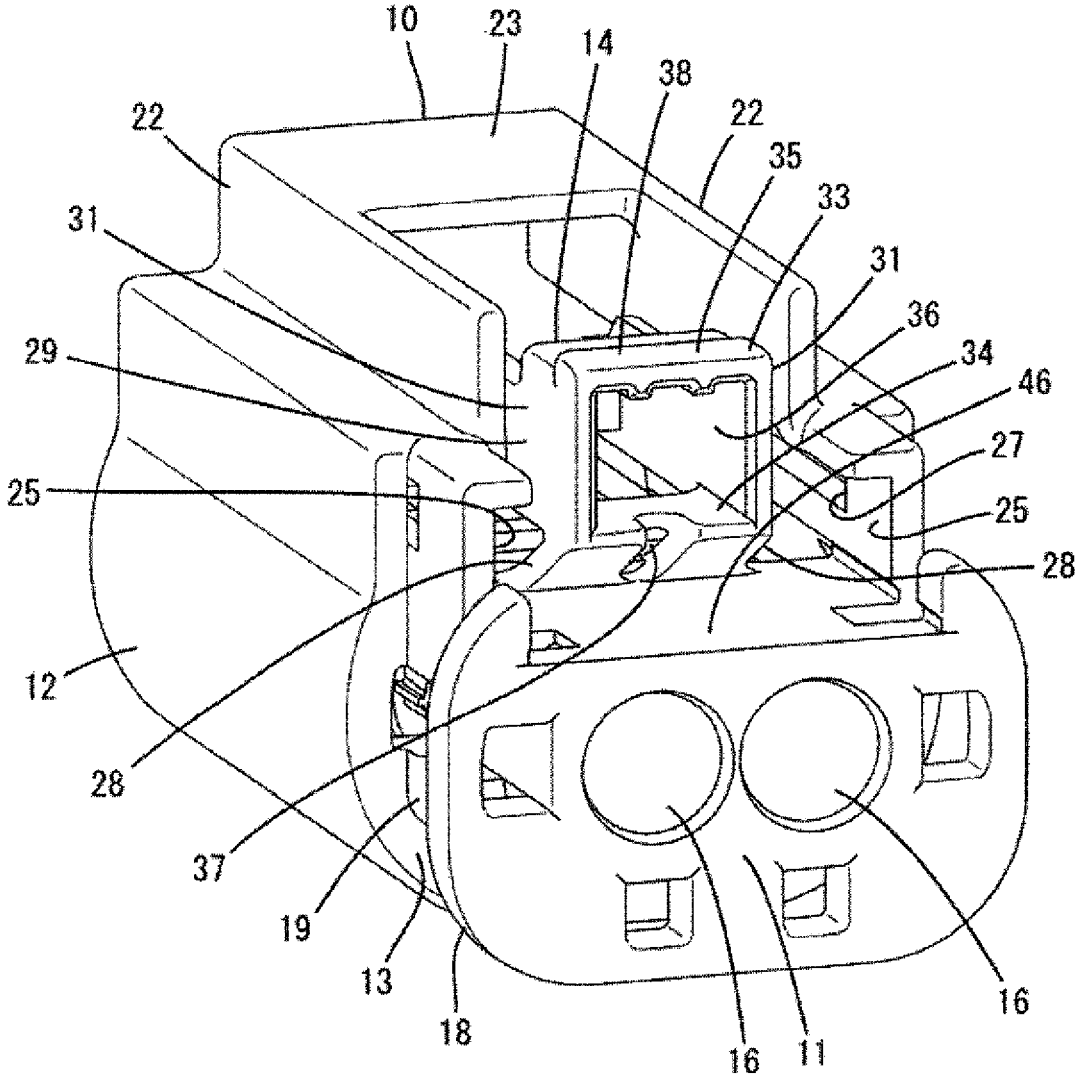
FIG. 5 is a perspective view of the housing viewed obliquely from above.

Cavities 16 penetrate the housing body 11 in the front-rear direction. As shown in FIG. 5, the respective cavities 16 are provided laterally side by side in the housing body 11. Unillustrated terminal fittings are inserted into the respective cavities 16 from behind.

As shown in FIG. 5, the housing body 11 includes a radially protruding flange 18 on a rear end part. A mounting groove 19 is provided circumferentially on the outer peripheral surface of the housing body 11 between the flange 18 and the coupling 13, and an unillustrated cover member is mounted therein.

As shown in FIG. 1, an annular sealing member 20 is fit on the outer peripheral surface of the housing body 11. The sealing member 20 is made of rubber, such as silicon rubber, and in contact with a step in front of the coupling 13. The sealing member 20 is radially compressed between the receptacle 91 and the housing body 11 when the housings 10, 90 are connected. The housings 10, 90 are sealed in a liquid-tight manner via the sealing member 20.

A front retainer 21 is mounted into the housing body 11 from the front. The front retainer 21 is made of synthetic resin, covers the front surface of the housing body 11 and functions to restrict forward escape of the sealing member 20 and secondarily retains the terminal fittings.

Figure 2:
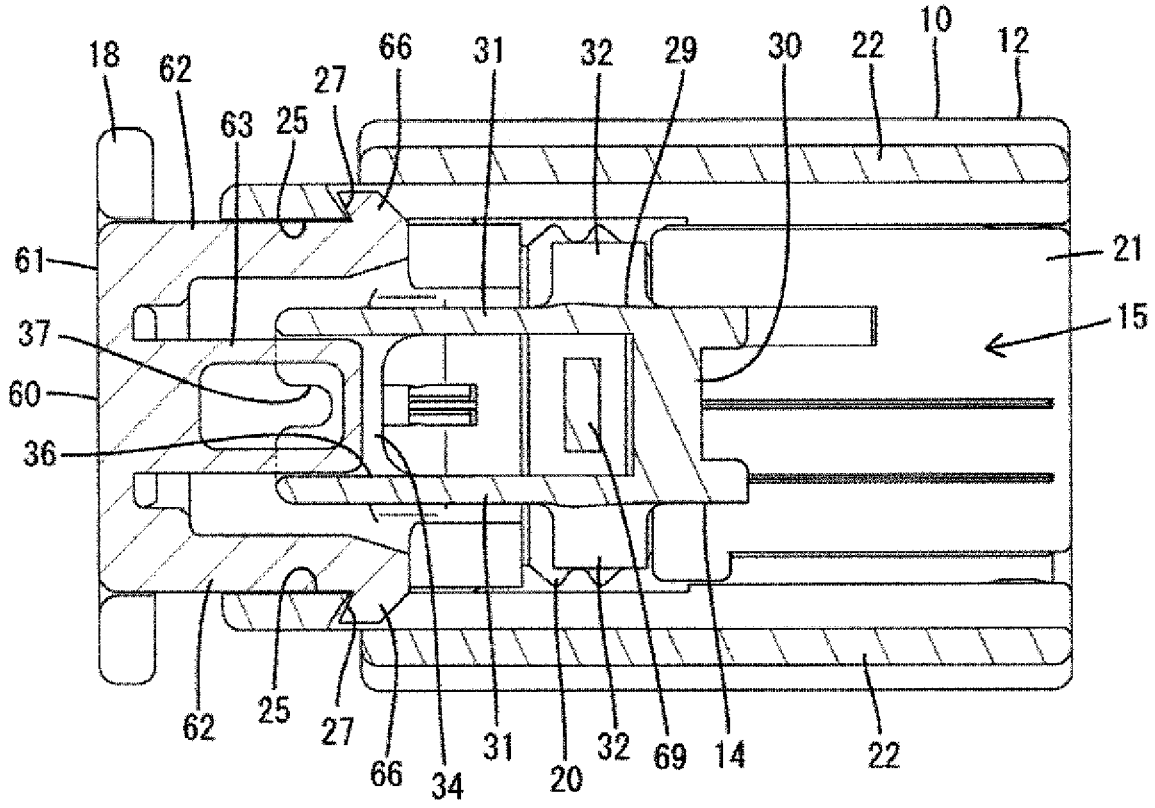
FIG. 2 is a plan view in section showing the state where the detecting member is kept at the standby position with respect to the housing.

As shown in FIG. 5, two side walls 22 are arranged on an upper part of the fitting tube 12. The side walls 22 are aligned vertically on both left and right sides of the lock arm 14, and an upper wall 23 extends between the upper ends of the side walls 22. The side walls 22 are formed from the front end of the housing 10 to positions near a rear end. Rearwardly open grooves 25 are formed on inner surfaces of the side walls 22 and extend in the front-rear direction, as shown in FIG. 5. Each groove 25 has a retaining portion 27 inclined to have a reverse taper with respect to a lateral direction, as shown in FIG. 2. The upper wall 23 is connected to front parts of the upper ends of the side walls 22.

The lock arm 14 is arranged behind the upper wall 23 and can be visually confirmed in a plan view. The lock arm 14 includes left and right legs 28 rising from the upper surface of the housing body 11, as shown in FIG. 5, and an arm body 29 extends forward from the upper ends of the legs 28, as shown in FIG. 1.

As shown in FIG. 2, a locking portion 30 extends laterally on a front part of the arm body 29 and includes two links 31 extending in the front-rear direction on both left and right sides of the locking portion 30. As shown in FIG. 1, an upper part of the rear surface of the locking portion 30 forms a slope 45 inclined gradually rearward toward an upper end.

The links 31 are in the form of plates extending along the front-rear and vertical directions. Front parts of the links 31 are connected to both left and right ends of the locking portion 30, and rear end parts thereof are connected to the both legs 28.

As shown in FIG. 5, a rectangular frame 33 is formed at a rear part the arm body 29. The frame 33 includes a stopper 34 laterally extending between the upper ends of the legs 28 and a releasing portion 35 is arranged to face the stopper 34 above the stopper 34. The stopper 34 and the releasing portion 35 are plates extending along the front-rear and lateral directions. Both left and right ends of the stopper 34 are connected to the lower ends of rear end parts of the links 31. Both left and right ends of the releasing portion 35 are connected to the upper ends of the rear parts of the links 31.

As shown in FIG. 2, the arm body 29 includes an insertion hole 36 behind the locking portion 30 and between the links 31. The insertion hole 36 penetrates through the frame 33 in the front-rear direction and is open upward and downward between the locking portion 30 and the frame 33. A later-described locking piece 63 of the detector 60 is inserted into the insertion hole 36 from behind.

The rear end of the stopper 34 includes a recess 37 located at a position between the legs 28 in the lateral direction and cut into a U shape.

As shown in FIG. 1, the releasing portion 35 is higher than other areas in the arm body 29. The upper surface of the releasing portion 35 is a flat surface exposed upward and includes a rib-like protrusion 38 extends laterally in a rear part. If the upper surface of the releasing portion 35 is pressed, the arm body 29 is inclined to displace the locking portion 30 up with both legs 28 as fulcrums.

As shown in FIG. 5, the upper surface of the housing body 11 has a flat slide-contact surface 46 extending along the lateral and front-rear directions between the sides 22 and below the legs 28. Later-described locking strengthening portions 76 of the detector 60 slide in contact with the slide-contact surface 46 of the housing body 11.

<Detector 60>

Figure 3:
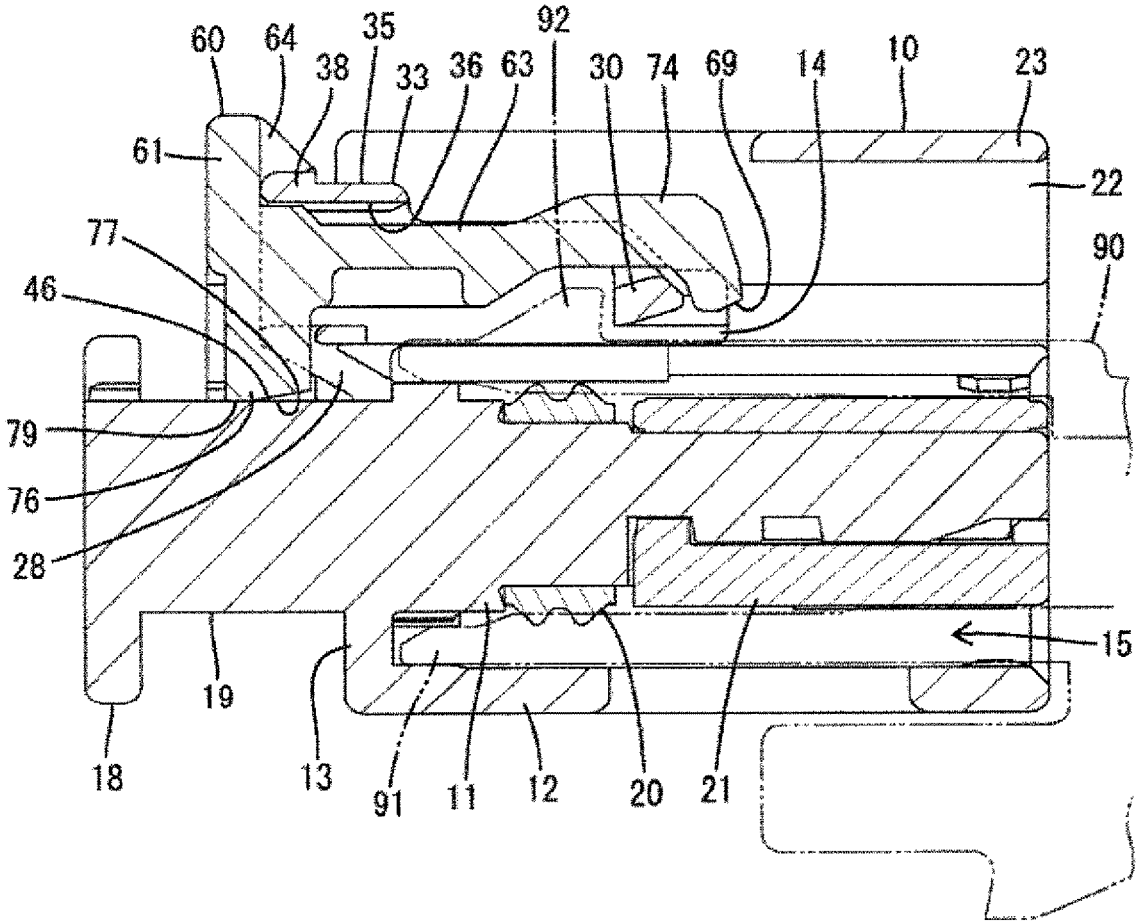
FIG. 3 is a side view in section showing the state where the detecting member is kept at the standby position with respect to the housing.
Figure 6:
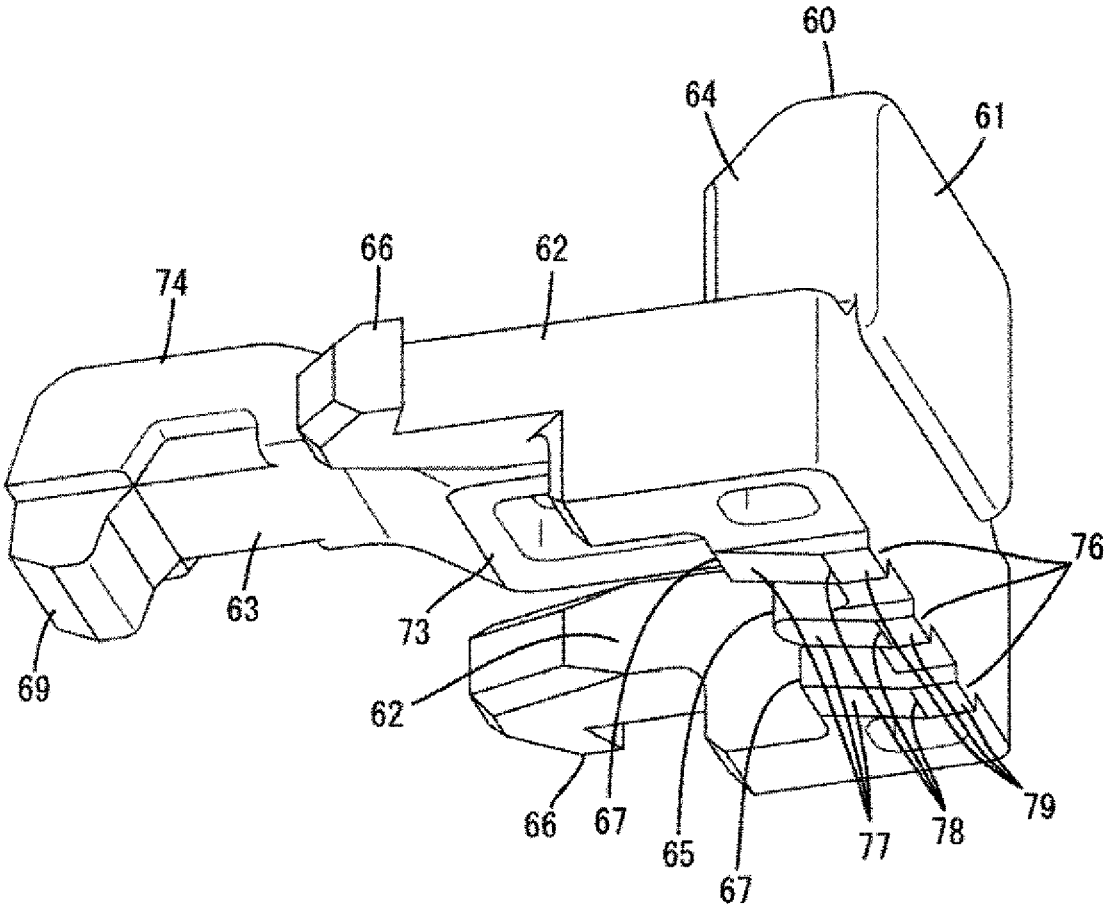
FIG. 6 is a perspective view of the detecting member viewed obliquely from below.
Figure 7:
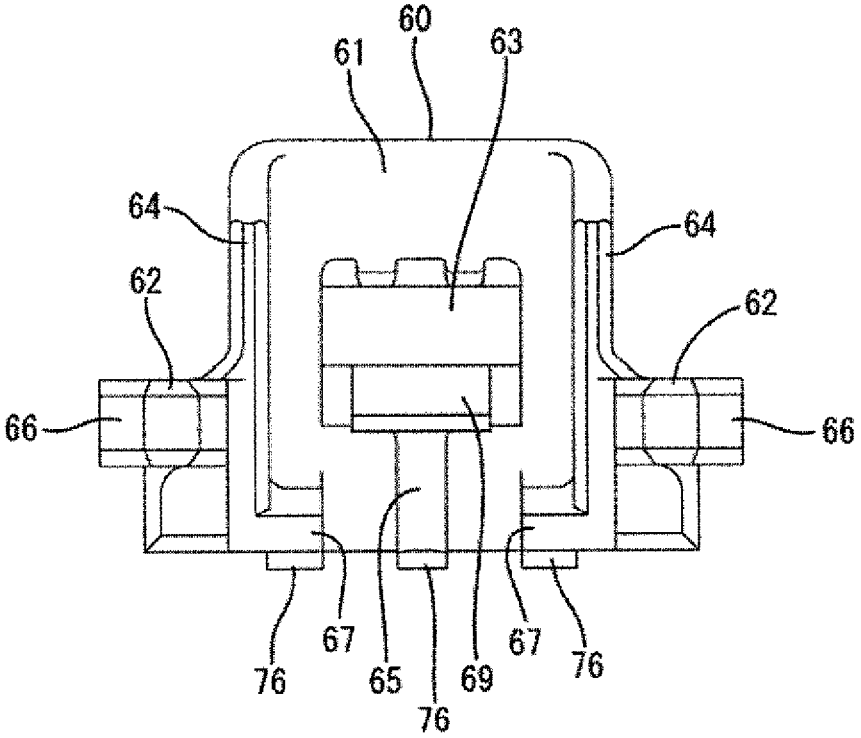
FIG. 7 is a front view of the detecting member.

The detector 60 is made of synthetic resin and includes, as shown in FIGS. 6 and 7, a wall 61 extending along the vertical and lateral directions. Two retaining pieces 62 project forward from both left and right ends of a lower part of the wall 61, and the locking piece 63 projects forward from a vertically and laterally intermediate part of the wall 61. The detector 60 is arranged with respect to the housing 10 movably in the front-rear direction to a standby position where the wall 61 is at a distance rearward from the arm body 29, as shown in FIGS. 1 and 2, and a detection position where the wall 61 can contact the rear end of the arm body 29, as shown in FIG. 3.

The wall 61 is aligned vertically and is dimensioned to cover a rear region between the side walls 22. Two rib-like projecting pieces 64 extend vertically on both left and right sides of the front surface of the wall 61 and continue over the entire height of the wall 61. The outer surfaces of lower parts of the both projecting pieces 64 are connected to the retaining pieces 62.

As shown in FIG. 7, the lower part of the wall 61 includes a rib-like fitting projecting piece 65 extending vertically in a laterally intermediate part of the front surface. Further, two claw-like reinforcing portions 67 project forward on both left and right sides of the lower part of the front surface of the wall 61. The outer surfaces of the reinforcing portions 67 are connected to the projecting pieces 64. The upper surfaces of the reinforcing portions 67 are inclined down toward the front. When the detector 60 is at the detection position, the upper surfaces of the reinforcing portions 67 are arranged along the rear surfaces of the legs 28.

The retaining pieces 62 are deflectable in and out (left and right) with base parts connected to both left and right end parts of the wall 61 as fulcrums. As shown in FIG. 2, the retaining pieces 62 fit into the grooves 25 of the side walls 22 and have rectangular cross-sectional shapes corresponding to the grooves 25. Claw-like retaining projections 66 project out on front end parts of the retaining pieces 62. The retaining projections 66 of the retaining pieces 62 are lockable to the retaining portions 27 of the side walls 22.

The locking piece 63 is vertically deflectable with a base part connected to a laterally intermediate part of the wall 61 as a fulcrum. The front end of the locking piece 63 is arranged in front of the front ends of the retaining pieces 62. The locking piece 63 is inserted into the insertion hole 36 of the arm body 29 through the inside of the frame 33.

As shown in FIG. 1, a rear part 73 of the locking piece 63 is shaped to extend straight forward from the wall 61. The rear part 73 of the locking piece 63 is connected to the upper end of the fitting projecting piece 65.

A front part 74 of the locking piece 63 has a part arranged above and higher than the rear part 73. The front part 74 of the locking piece 63 includes a claw-like locking projection 69 projecting down from a tip part. The front surface of the locking piece 63 becomes gradually upright in the vertical direction from an upper part to a lower part. The front part 74 of the locking piece 63 is curved up in a side view.

As shown in FIGS. 6 and 7, the detector 60 includes rib-like locking strengthening portions 76 projecting on the lower surface of the wall 61. Three locking strengthening portions 76 are provided at intervals in the lateral direction on the lower surface of the wall 61. Specifically, the respective locking strengthening portions 76 include the locking strengthening portion 76 on a middle position from the side of the wall 61 to a lower surface side of the fitting projecting piece 65 in a laterally intermediate part of the lower surface of the wall 61 and two locking strengthening portions 76 provided from the side of the wall 61 to lower surface sides of the reinforcing portions 67 on both left and right sides of the lower surface of the wall 61. As shown in FIG. 6, each locking strengthening portion 76 has a trapezoidal shape with a flat end surface 79 extending along the front-rear direction. The front of each locking strengthening portion 76 is an inclined surface 77 inclined down toward the rear. Each locking strengthening portion 76 includes a linear boundary portion 78 extending along the lateral direction between the inclined surface 77 and the end surface 79.

Each locking strengthening portion 76 is lower than other parts in the detector 60. The detector 60 is supported on the slide-contact surface 46 of the housing body 11 by each locking strengthening portion 76.

Figure 4:
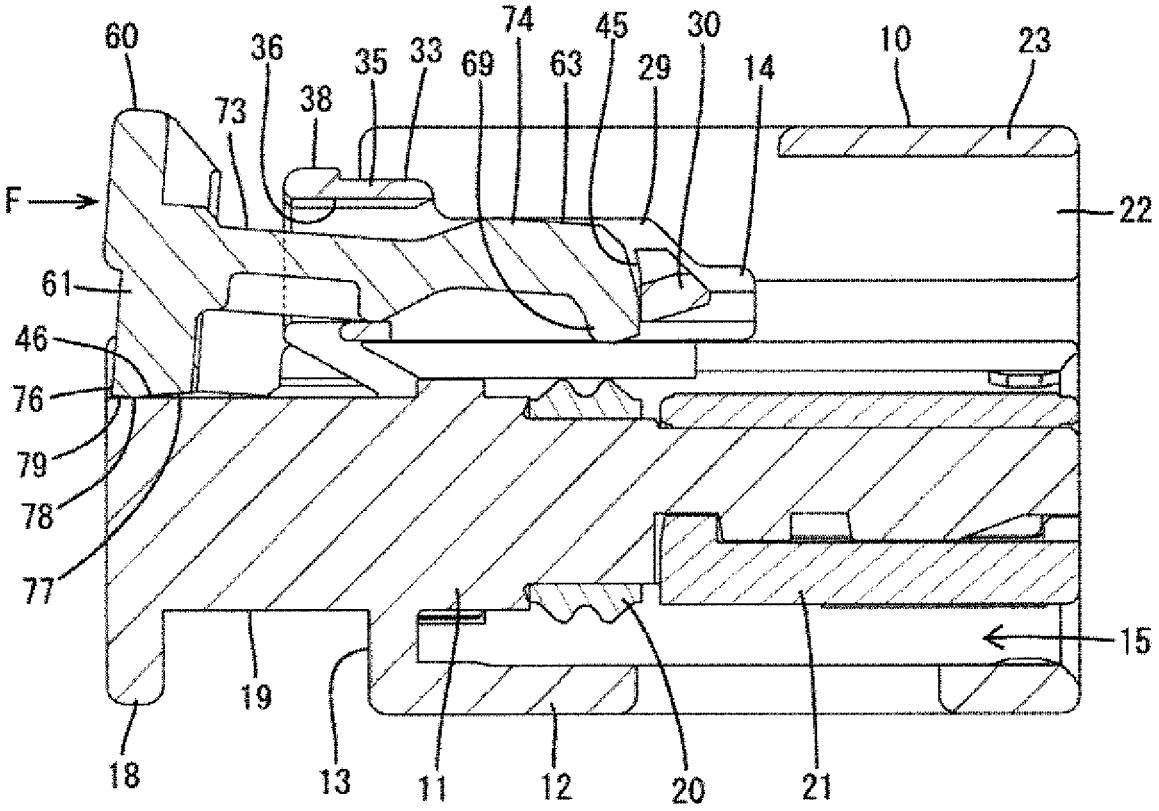
FIG. 4 is a side view in section showing a state where a pushing force to a detection position is applied to the detecting member when the housing is in a single body state and the detecting member is inclined by locking strengthening portions.

If the detector 60 is in a proper movement posture, the wall 61 is arranged along the vertical direction and the retaining pieces 62 and the locking piece 63 are arranged along the horizontal direction, as shown in FIG. 1. When the detector 60 moves from the standby position to the detection position, the end surface 79 of each locking strengthening portion 76 can slide in contact with the slide-contact surface 46 of the housing body 11. On the other hand, if the detector 60 is in a displacement posture inclined from the proper movement posture, the wall 61 is leans forward and the retaining pieces 62 and the locking piece 63 are lowered toward the front, as shown in FIG. 4. Thus, the inclined surface 77 of each locking strengthening portion 76 can approach the slide-contact surface 46 of the housing body 11 and the inclined surface 77 or the boundary portion 78 can slide in contact with the slide-contact surface 46.

<Mating Housing 90>

The mating housing 90 is made of synthetic resin and fixed to a device of an unillustrated vehicle. As shown in FIG. 3, the mating housing 90 includes the tubular receptacle 91 projecting forward. Unillustrated mating terminal fittings project into the receptacle 91. A lock protrusion 92 projects on the upper surface of the receptacle 91.

<Connector Connecting/Separating Method and Connection Detecting Method>

Prior to the connection of the connector, the detector 60 is assembled with the housing 10 from behind. When the detector 60 reaches the standby position, the retaining pieces 62 are fit into the grooves 25 of both side walls 22, and the retaining projections 66 thereof face and lock to the retaining portions 27, as shown in FIG. 2. Additionally, the locking projection 69 of the locking piece 63 faces and is lockable to the rear surface of the locking portion 30 of the arm body 29, as shown in FIG. 1. In this way, the detector 60 is held at the standby position with respect to the housing 10 with a movement in the front-rear direction restricted.

The retaining pieces 62 of the detector 60 can contact the inner upper surfaces of the grooves 25 of the side walls 22 with each locking strengthening portion 76 held in contact with the slide-contact surface 46 of the housing body 11. In this way, a clearance between the detector 60 and the housing 10 in the vertical direction (direction intersecting a moving direction of the detector 60) is filled and the rattling of the detector 60 in the vertical direction with respect to the housing 10 is restricted. A state where the rattling of the detector 60 is restricted is maintained constantly while the detector 60 is assembled with the housing 10.

Subsequently, the receptacle 91 of the mating housing 90 is inserted into the fitting space 15 of the housing 10. In the process of connecting the housings 10, 90, the lock protrusion 92 interferes with the locking portion 30, and the lock arm 14 is deflected and deformed with both legs 28 as fulcrums. The lock protrusion 92 slides on the lower surface of the locking portion 30. When the housings 10, 90 are connected properly, the lock arm 14 resiliently returns, the arm body 29 is arranged along the front-rear direction and the lock protrusion 92 is inserted into the insertion hole 36 of the arm body 29 from below. The lock protrusion 92 is faces and is lockable to the rear surface of the locking portion 30 to hold the housings 10, 90 in a connected state. When the housings 10, 90 are connected properly, the terminal fittings are connected electrically to the mating terminal fittings. Further, the receptacle 91 is held resiliently in close contact with the sealing member 20 and liquid-tight sealing is provided between the receptacle 91 and the housing body 11.

Further, as the lock protrusion 92 of the mating housing 90 is inserted into the insertion hole 36, the locking projection 69 is pressed by the lock protrusion 92 to displace upward. In this way, the locking of the locking projection 69 and the locking portion 30 is released and the detector 60 becomes movable forward toward the detection position.

Subsequently, the upper part of the wall 61 is held with fingers, and the detector 60 is pushed forward. In the process of moving the detector 60, the end surface 79 of each locking strengthening portion 76 slides in contact with the slide-contact surface 46 of the housing body 11. Further, in the process of moving the detector 60, the rear part 73 of the locking piece 63 is displaced in the frame 33, the front part 74 of the locking piece 63 is deflected and the locking projection 69 slides in contact with the upper surface of the locking portion 30. When the detector 60 reaches the detection position, the locking piece 63 resiliently returns and, as shown in FIG. 3, the locking projection 69 faces and locks to the front surface of the locking portion 30.

At the detection position, the front surface of the lower part of the wall 61 is in contact with the stopper 34, the fitting projecting piece 65 is inserted in the recess 37 and the projecting pieces 64 are arranged to face the outer surfaces of the links 31 to embrace the frame 33. A movement of the detector 60 farther forward than the detection position is restricted by the contact of the wall 61 with the stopper 34.

As described above, when the housings 10, 90 are connected properly, the detector 60 is movable from the standby position to the detection position. On the other hand, if the housings 10, 90 do not reach the properly connected state, the lock protrusion 92 is not inserted into the insertion hole 36 and the locking of the locking projection 69 and the locking portion 30 is maintained. Thus, even if a forward pushing force is applied to the detector 60, the detector 60 cannot be moved to the detection position. Thus, it can be detected that the housings 10, 90 are connected properly if the detector 60 becomes movable to the detection position.

On the other hand, in separating the housings 10, 90 for maintenance or other reason, the upper part of the wall 61 is pulled strongly pulled. Then, the locking projection 69 rides over the locking portion 30 and the detector 60 is returned to the standby position while the locking piece 63 is deflected. At this time, the locking projection 69 rides on the lock protrusion 92 and the front part 74 of the locking piece 63 is deflected and deformed.

Subsequently, a pressing force is applied to the releasing portion 35 from above. Then, the lock arm 14 is deflected and deformed with the legs 28 as fulcrums, and the front end of the arm body 29 is displaced upward. In this way, the locking projection 69 is disengaged from the locking portion 30. In that state, the housings 10, 90 are pulled in separating directions and pulled apart from each other. On the other hand, even if a pressing force is applied to the detector 60 from above, the locking of the locking projection 69 and the locking portion 30 is not released since the lock arm 14 is not interlocked with the detector 60.

A pushing force to the detection position may be applied to the detector 60 due to the interference of external matter or the like when the detector 60 is at the standby position with respect to the housing 10 and before the housings 10, 90 are connected. In this case, if the locking piece 63 is deflected and deformed upward, the locking projection 69 slides upward in contact with the rear surface of the locking portion 30 and a locking engagement of the locking projection 69 and the locking portion 30 is reduced. There is a concern that a further pushing force can release the locking of the locking projection 69 and the locking portion 30, and the detector 60 may inadvertently move to the detection position.

However, in this embodiment, if a pushing force to the detection position (see an arrow F of FIG. 4) is applied to the upper part or the like of the wall 61 of the detector 60 when the detector 60 is at the standby position with respect to the housing 10 before the housings 10, 90 are connected, the locking projection 69 contacts the slope 45 of the locking portion 30 and a reaction force to displace the front part 74 downward is generated for the locking piece 63. By applying the reaction force to the locking piece 63, each locking strengthening portion 76 is inclined to be lowered toward the front, the wall 61 leans forward and the detector 60 also is inclined to take a displacement posture, as shown in FIG. 4.

In the process of the detector 60 taking the displacement posture, the locking projection 69 slides down in contact with the rear surface of the locking portion 30 and the locking engagement of the locking projection 69 and the locking portion 30 is increased. If a further pushing force is applied to the detector 60 in this state, the inclined surface 77 of each locking strengthening portion 76 faces the slide-contact surface 46 of the housing body 11 to be able to slide in contact with the slide-contact surface 46 and the locking engagement of the locking projection 69 and the locking portion 30 is increased.

As described above, according to this embodiment, even if a pushing force to the detection position is applied accidentally to the detector 60 before the housing 10 is connected to the mating housing 90, each locking strengthening portion 76 displaces the detector 60 in a direction to increase the locking engagement of the locking projection 69 and the locking portion 30. Thus, the locking of the locking projection 69 and the locking portion 30 is not released inadvertently and the detector 60 can be kept reliably at the standby position. As a result, the reliability of connection detection by the detector 60 can be enhanced.

Further, since each locking strengthening portion 76 has the inclined surface 77 inclined to face the slide-contact surface 46 of the housing body 11, the detector 60 can be inclined smoothly to take the displacement posture. In addition, each locking strengthening portion 76 does not have a particularly complicated structure.

Furthermore, each locking strengthening portion 76 is a rib capable of filling up the clearance between the detector 60 and the housing 10 in the vertical direction. Thus, there is no need for a dedicated backlash eliminating structure to fill up the clearance between the detector 60 and the housing 10 and a configuration can be simplified.

It should be understood that the embodiment disclosed is illustrative in all aspects and not restrictive.

For example, although the locking strengthening portions 76 are provided on the detector 60 in the above embodiment, locking strengthening portions may be provided on a slide-contact surface of a housing body as another embodiment. Further, locking strengthening portions may be provided on both a detector and a housing body.

Although plural locking strengthening portions 76 are provided in the above embodiment, only one locking strengthening portion may be provided as another embodiment. In this case, the locking strengthening portion may extend, for example, in a lateral direction in a part where a detector and a housing slide in contact.

Although the locking strengthening portion 76 has the linearly inclined surface 77 in the above embodiment, a curved inclined surface may be provided.

Although the detector 60 is moved manually to the detection position after the housings 10, 90 are connected in the above embodiment, a detector may be automatically moved to a detection position by a biasing force of a biasing member after both housings are connected.

LIST OF REFERENCE SIGNS

10 . . . housing
11 . . . housing body
12 . . . fitting tube
13 . . . coupling
14 . . . lock arm
15 . . . fitting space
16 . . . cavity
18 . . . flange

19 . . . mounting groove
20 . . . sealing member
21 . . . front retainer
22 . . . side wall
23 . . . upper wall
25 . . . groove
27 . . . retaining portion
28 . . . leg
29 . . . arm body
30 . . . locking portion
31 . . . link
33 . . . frame
34 . . . stopper
35 . . . releasing portion
36 . . . insertion hole
37 . . . recess
38 . . . protrusion
45 . . . slope
46 . . . slide-contact surface
60 . . . detector
61 . . . wall
62 . . . retaining piece
63 . . . locking piece
64 . . . projecting piece
65 . . . fitting projecting piece
66 . . . retaining projection
67 . . . reinforcing portion
69 . . . locking projection
73 . . . rear part (of locking piece)
74 . . . front part (of locking piece)
76 . . . locking strengthening portion
77 . . . inclined surface
78 . . . boundary portion
79 . . . end surface
90 . . . mating housing
91 . . . receptacle
92 . . . lock protrusion

What is claimed is:

1. A connector, comprising:

a housing connectable to a mating housing;

a deflectable lock arm provided on the housing, the lock arm locking the mating housing in a connected state;

a detector arranged movably between a standby position and a detection position with respect to the housing, the detector being allowed to move from the standby position to the detection position after the housings are connected, the detector including a locking piece to be locked to the lock arm at the standby position before the housings are connected; and a locking strengthening portion provided on at least one of opposed facing surfaces of the detector and the housing, the locking strengthening portion having an inclined surface inclined relative to a moving direction of the detector from the standby position to the detection position so that sliding contact of the inclined surface of the locking strengthening portion with one of the opposed facing surfaces of the detector and the housing displaces the detector in a direction to increase a locking engagement of the locking piece and the lock arm when the detector moves from the standby position to the detection position.

2. The connector of claim 1, wherein the locking strengthening portion is provided on the detector.

3. The connector of claim 1, wherein the locking strengthening portion comprises at least one rib.

4. The connector of claim 3, wherein the at least one rib comprises plural ribs spaced from one another in a direction transverse to a moving direction of the detector from the standby position to the detection position.

5. A connector, comprising:

a housing connectable to a mating housing;

a deflectable lock arm provided on the housing, the lock arm locking the mating housing in a connected state;

a detector arranged movably between a standby position and a detection position with respect to the housing, the detector being allowed to move from the standby position to the detection position after the housings are connected, the detector including a locking piece to be locked to the lock arm at the standby position before the housings are connected; and a locking strengthening rib provided on a surface of the detector facing the housing, the locking strengthening rib having an inclined surface facing the housing and being inclined in a direction to increase a locking engagement of the locking piece and the lock arm as the detector moves from the standby position to the detection position, the locking strengthening filling up a clearance between the detector and the housing in a direction intersecting a moving direction of the detector.

* * * * *